US006213367B1

(12) United States Patent
Flamm

(10) Patent No.: US 6,213,367 B1
(45) **Date of Patent: *Apr. 10, 2001**

(54) METHOD OF CONTROLLING THE DRIVE TRANSPORTING A PAPER WEB IN A PRINTING MACHINE

(75) Inventor: Heinz Flamm, Villmergen (CH)

(73) Assignee: Asea Brown Boveri AG, Baden (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/223,631

(22) Filed: Dec. 31, 1998

(30) Foreign Application Priority Data

Feb. 2, 1998 (EP) ..... 98101727

(51) Int. Cl.[7] ..... B65H 23/192
(52) U.S. Cl. ..... 226/42; 226/24
(58) Field of Search ..... 226/24, 38, 42; 242/418

(56) References Cited

U.S. PATENT DOCUMENTS

| | | | | |
|---|---|---|---|---|
| 3,722,769 | * | 3/1973 | Aplet et al. | 226/42 X |
| 4,369,906 | * | 1/1983 | Isherwood | 226/83 X |
| 4,729,520 | * | 3/1988 | Kataoka | 226/24 X |
| 4,848,630 | * | 7/1989 | Niestrath et al. | 226/24 X |
| 4,951,895 | * | 8/1990 | Hirai | 226/38 X |
| 5,045,134 | * | 9/1991 | Schenker et al. | 226/24 X |
| 5,166,490 | * | 11/1992 | Morishita et al. | 226/42 X |
| 5,240,194 | * | 8/1993 | Noirot et al. | 226/24 X |
| 5,269,222 | | 12/1993 | Johnson et al. . | |
| 5,524,805 | | 6/1996 | Shiba et al. . | |
| 5,676,479 | * | 10/1997 | Yamaguchi et al. | 226/24 X |
| 5,709,331 | * | 1/1998 | Lam et al. | 226/42 X |
| 5,903,794 | * | 5/1999 | Sheley et al. | 226/24 X |
| 5,918,787 | * | 7/1999 | Hecky | 226/42 X |

FOREIGN PATENT DOCUMENTS

| | | |
|---|---|---|
| 3519840A1 | 12/1986 | (DE) . |
| 4344896A1 | 7/1995 | (DE) . |
| 19626287A1 | 2/1997 | (DE) . |
| 0355442A2 | 2/1990 | (EP) . |

* cited by examiner

*Primary Examiner*—Donald P. Walsh
*Assistant Examiner*—Colling A. Webb
(74) *Attorney, Agent, or Firm*—Burns, Doane, Swecker & Mathis, L.L.P.

(57) ABSTRACT

A method of controlling the drive of the electric pretensioning unit of rotary printing machines having individually driven rotary printing cylinders and folders is specified, so that, in the event of changes being made to the paper grade or to the production sequence without the machine being stopped, only slight web tension changes occur, and the operating limits with regard to web tension are reliably maintained. This method is equally well suited to rotary printing machines having individually driven printing units or printing bridges and folders and to conventional printing machines that are driven by mechanical shafts via couplings.

9 Claims, 2 Drawing Sheets

METHOD OF CONTROLLING THE DRIVE TRANSPORTING A PAPER WEB IN A PRINTING MACHINE

BACKGROUND OF THE INVENTION

1. Field of the Invention

The invention relates to the field of printing technology. It is based on a method of controlling the drive for transporting a paper web in a printing machine according to the preamble of the first claim.

2. Discussion of Background

The invention is particularly advantageously used for shaftless rotary printing machines. A shaftless rotary printing machine having blanket and plate or forme cylinders combined in pairs to form cylinder groups is described in DE 43 44 896 A1. A method of operating a drive system which is suitable, in particular, for shaftless rotary printing machines is described by DE 196 26 287 A1. According to this method, the torque control of the driven axles has superimposed on it speed control (rotational speed control) or position control (angular position controls). In this case, in order to control the individual drives for printing cylinders and folders under the stringent requirements for angularly synchronised running which rotary printing machines have to meet, use is preferably made of position controls.

A significant advantage of individually driven rotary printing machines is that these machines are capable of carrying out a product change while the machine is running. Such product changes include the throwing on and throwing off of printing points, as well as changes of paper graded while the machine is running, which may lead to considerable and impermissible changes in the paper web tensions.

During the operation of drive groups which are controlled in this way—and in particular when products changes are also carried out while the machine is running, or when changes of paper grade take place within continuous production—undesired subsidiary phenomena occur, such as excessively fluctuating web tensions and, as a result of this, for example paper breaks.

The conventional methods of controlling the drive for transporting a paper web primarily involve two modes of operation: the drives are controlled either to constant speed or to constant web tension. These methods have, in either form, the disadvantage that:

- The paper draw between the threading mechanism and the printing unit builds up only very slowly when the machine is being started up.
- The web tension fluctuates to a relatively pronounced extent during normal operation.
- During a change of paper grade or of production sequence, the web tension fluctuates to an extremely pronounced extent, which can be attributed to the abruptly changed paper web lengths when throwing on or throwing off the printing units. This applies both when the web is guided over a plurality of printing towers and also when it is guided within one printing tower, a turning tower or the folder.
- The web tension is not maintained if the machine is stopped in an emergency.

All these disadvantages can be attributed to the fact that

- on the one hand, the paper properties of the running web change and, in the case of constant speed control, frequent and large-scale control compensation operations necessarily have to be carried out and
- on the other hand, the machine is not able to compensate for such control deviations in the desired time, from the point of view of control dynamics, and in addition has a tendency to an oscillatory behavior.

SUMMARY OF THE INVENTION

Accordingly, one object of the invention is to provide a novel method of controlling the drive of the paper web in a printing machine, in which method in all possible modes of operation of the rotary printing machine, and with or without a change of paper grade or in the content of the printed product while the machine is running, the web tension does not exhibit any noticeable fluctuations and deviations are compensated for rapidly. This object is achieved by the features of the first claim.

The core of the invention is that the control of the drives of the paper web, for example in the pretensioning units or the turning towers of a rotary printing machine, takes into account both speed and web tension in a flexible manner. This enables considerably better paper guidance with controlled web tension, both in static and in dynamic operation. In the simplest case, this is achieved by means of settings of the speed controller, with the result that the latter shows a distinct dependence of the drive torque on the deviation between desired and actual speed. This controller deviation is taken into account in the reference desired value, and a suitable operating point is thereby set. In the event of a production-induced variation in the machine configuration, the current operating point is displaced along a curve (loading curve), both the speed actual value and the drive torque being changed. The slope of this curve is a measure of the influence of the load change on speed and torque. It is preferably selected such that the drive torque and hence the web tension are kept within the operating limits. The reference desired value determines the static and dynamic guiding behavior to a large extent.

A distinction may be drawn between pre-controlled and controlled operation. In the simpler case of pre-controlled operation (open loop), known influencing variables of the process to be controlled are taken into account. In a first step, therefore, the steady-state operating case and acceleration-dependent variables are preset. In the optional controlled operation (closed loop), the web tension, for example, is measured; it acts on the reference desired value via a control algorithm. This ensures that residual errors are controlled out.

Clear-cut advantages are achieved in comparison with operation according to the prior art:

- In pre-controlled operation, high static accuracy of the web tension is achieved, this having a low sensitivity to interfering variables.
- Since the abovedescribed loading curve is part of the speed controller, the behavior exhibits extremely high dynamics. Characteristic reaction times of less than one millisecond are therefore possible. This is significantly faster than in the case of conventional web tension control.
- Furthermore, the loading curve leads to damping of mechanical oscillations. This property is important above all in the case of mechanical stimuli, such as those which occur when the paper grade or the production sequence is changed.

Further advantageous embodiments emerge from the corresponding dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Figure 1:
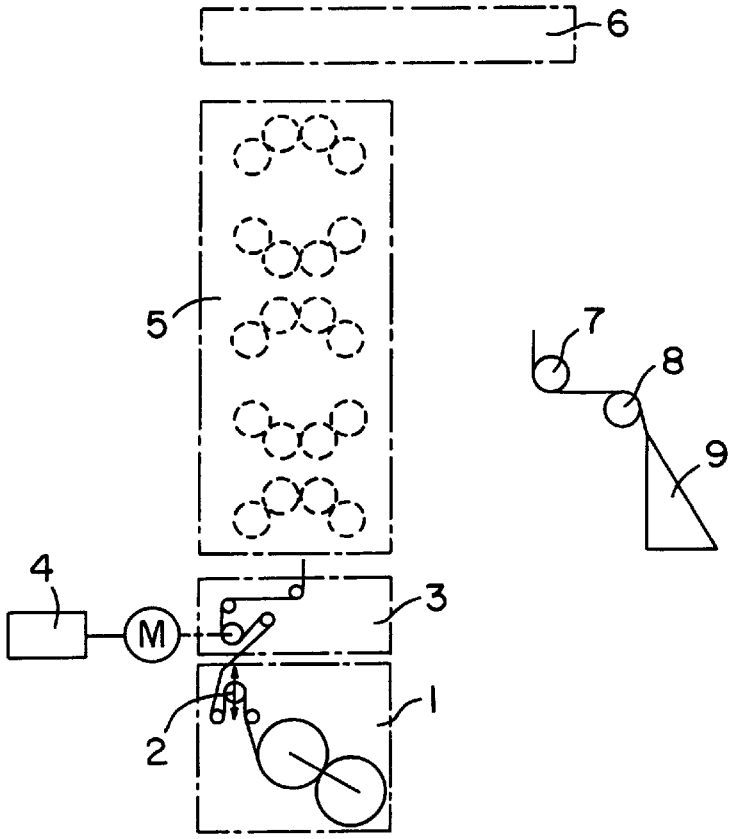
FIG. 1 shows a schematic illustration of the rotary printing machine together with the elements influencing the web tension.

The reference symbols used in the drawings and their meaning are listed in summary in the list of designations.

DESCRIPTION OF THE PREFERRED EMBODIMENTS

Referring now to the drawings, wherein like reference numerals and symbols designate identical or corresponding parts throughout the several views, FIG. 1 shows a schematic illustration of the rotary printing machine together with the elements influencing the web tension. Designated as the paper guide or paper path is the path through which the paper to be printed runs from the reel changer (1), via the dancer roll (2) and the electric pretensioning unit (3), over any desired combination of printing units in the printing tower (5) or in a plurality of printing towers, and via a turning tower (6), collecting roll (7), former inlet roll (8) until it reaches the folder (9). The web tension of the paper web is set at the electric pretensioning unit (3) via the drive (M) and the controller (4), and it is not permissible to exceed or fall below predefined limiting values. If, then, a paper grade is changed at the reel changer (1) while the machine is running, the web tension changes abruptly because of the changed paper properties (case 1). If the printing tower is equipped with individually driven printing units or printing bridges, the production sequence can be changed while the machine is running. Such product changes include the throwing on and throwing off of the printing units needed for the two production sequences. During this operation, the paper web is free to some extent for some of the time. As a consequence of this, the web tension of the paper web varies considerably (case 2). The two cases are the basis for the present invention, in order to compensate for the web tension changes within the shortest possible time and to keep them within the permissible limiting values.

In the following text, the inventive method will be explained with reference to the drive control of a pretensioning unit. However, it is, of course, possible for the method to be used wherever the paper web has to be driven, that is to say in particular in the turning towers as well.

Figure 2:
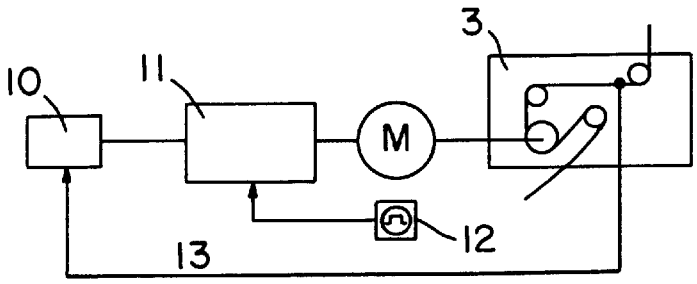
FIG. 2 shows a schematic illustration of the controller for the electric pretensioning unit of a rotary printing machine.

FIG. 2 illustrates a control device for the electric pretensioning unit (3), this control device being suitable for the inventive method. The reference desired value is formed in the desired value transmitter (10). The reference desired value may be a speed or a position, depending on the application of the control method. In the controlled exemplary embodiment according to FIG. 2, a difference is formed, in the desired value transmitter (10), between the reference desired value and a function of the web tension actual value (13), which is measured on the paper web in the pretensioning unit (3). This variable serves as a reference variable for the drive controller (11) connected downstream. In the uncontrolled case, the reference desired value is forwarded directly as reference variable. The drive controller (11) exhibits a socalled droop behavior, that is to say it permits the inventive, load-dependent lowering or raising of the speed. In the controller (11), a drive actual value is measured—normally a position or a speed—and is compared with the reference variable and a resulting control deviation is formed therefrom. The manipulated variable is fed to the converter of the motor in such a way that the motor is driven as desired.

Figure 3:
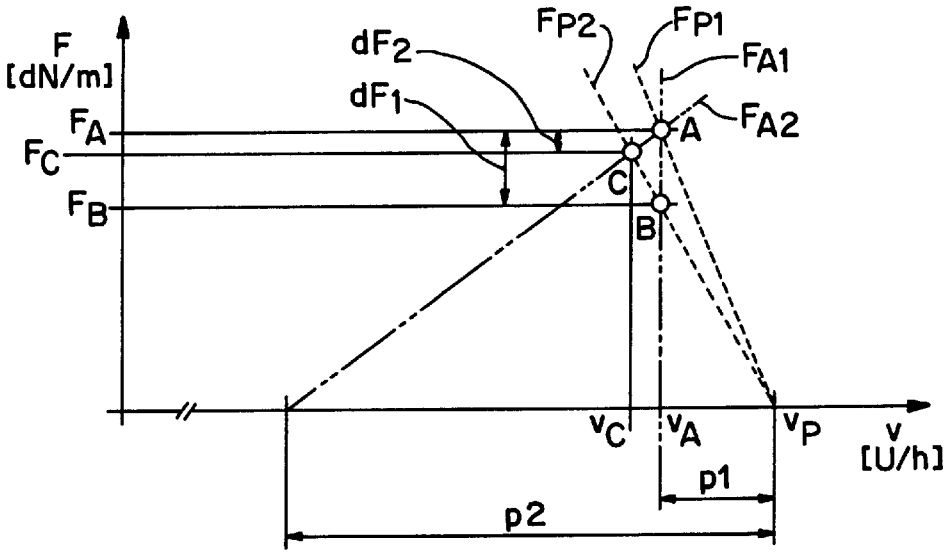
FIG. 3 shows a diagram to illustrate the dependent relationships between web tension and speed in the case of different paper grades or production sequences.

The inventive behavior of the controller (11) is explained in more detail below with the aid of FIG. 3, with reference to the various operating cases and the inventive web tension/speed characteristic curves. The abscissa axis shows the machine speed (v), which is normally specified in cylinder rotations per hour. Plotted on the ordinate axis is the paper tension (F). This is usually related to the respective paper width and specified in daN/m. Droop denotes that property of the device (11) with which load-dependent lowering or raising of the speed desired value is effected.

The starting point in the diagram is the production speed ($v_P$). A conventional position-controlled or speed-controlled pretensioning unit is operated with a lag (p1), from which its loading curve ($F_{A1}$) is obtained. On the other hand, the paper tension of the paper grade 1 or of the production sequence 1 increases as the lag (p1) of the pretensioning unit increases. The web tension therefore runs in accordance with ($F_{P1}$). The resulting operating point is located at the point of intersection (A) of the two curves. If the paper grade or the production sequence is changed, the characteristic may change. In the event of a change of the characteristic from ($F_{P1}$) to ($F_{P2}$), the operating point changes from (A) to (B) In the case of speed control in accordance with the loading curve $F_{A1}$, the speed $V_A$ is kept constant, even in the event of load torque changes. This results in an impermissible change in the paper tension by the amount $dF_1=F_A-F_B$.

This impermissible operating state is avoided, using the inventive method, by means of the loading curve ($F_{A2}$). With increasing paper tension (F), the loading curve leads to an increasing machine speed (v). The lag of the reference desired value (p2) is considerably greater here. Starting from the paper grade 1 or from the production sequence 1, the operating point (A), in turn, is set at speed (VA) and paper tension ($F_A$). A change in paper grade or in production sequence to the characteristic ($F_{P2}$) then leads to the new operating point (C). The latter contains both a changed paper tension ($F_C$) and a changed speed ($v_c$). The drive therefore reacts to the change in the process variables with both state variables (v and F). Not only is the web tension F (or the drive torque) made to follow, but the speed is likewise raised or lowered in accordance with the load change. The relationship between speed change and load change may be linear or else nonlinear. As a result of the influence of the inventive method, the resulting paper tension change (dF2) is considerably smaller, or it can even virtually be eliminated completely. Although this is obtained at the expense of the speed (v), the product quality is not affected in any way.

The inventive control method has been explained above with reference to the pretensioning unit. However, it can be used wherever a paper web has to be driven in a printing machine, that is to say in particular in the turning towers as well. The advantage of the inventive method resides specifically in the fact that, in the event of load changes during operation, impermissible web tension changes which overload the paper web as it is being transported do not occur.

Obviously, numerous modifications and variations of the present invention are possible in light of the above teachings. It is therefore to be understood that, within the scope of the appended claims, the invention may be practiced otherwise than as specifically described herein.

What is claimed is:

1. A method of controlling the drive for transporting a paper web in a printing machine, the drive, when operating, rotating at a specific drive speed v and producing a drive torque and a web tension, wherein target variables of speed v and drive torque are set simultaneously, the method comprising the steps of:

measuring a drive actual value;

determining a control deviation by comparing the drive actual value with a reference variable; and controlling the drive based on the control deviation, wherein each drive torque value is associated with a different drive speed v, causing the drive controller to lower or raise the drive speed v as a function of a load torque of the drive.

2. The method as claimed in claim 1, wherein the dependent relationship between the change in load torque and the lowering or raising of the speed is linear.

3. The method as claimed in claim 1, wherein the dependent relationship between the change in load torque and the lowering or raising of the speed is nonlinear.

4. The method as claimed in claim 1, wherein the dependent relationship between the change in load torque and the lowering or raising of the speed is a function of time.

5. The method of claim 1, wherein the drive actual value and the reference variable are position values.

6. The method of claim 1, wherein the drive actual value and the reference variable are speed values.

7. The method of claim 1, wherein the drive speed and the drive torque are related by a loading curve.

8. The method of claim 7, wherein the reference variable is determined from a reference desired value that is adapted in accordance with the loading curve in order to obtain a predetermined operating point of the drive.

9. The method of claim 8, wherein a web tension value is measured and a function of this tension value is added to the reference desired value to obtain the reference variable.

* * * * *